US011365881B2

(12) United States Patent
Mösl et al.

(10) Patent No.: US 11,365,881 B2
(45) Date of Patent: Jun. 21, 2022

(54) BURNER WITH IMPROVED ORIFICE PLATE

(71) Applicant: Webasto SE, Stockdorf (DE)

(72) Inventors: Klaus Mösl, Stockdorf (DE); Björn Smigiel, Stockdorf (DE); Paul Leinsle, Stockdorf (DE); Vitali Dell, Stockdorf (KR); Matthias Pfau, Stockdorf (DE); Marcus Gowitzke, Stockdorf (DE)

(73) Assignee: WEBASTO SE, Stockdorf (DE)

( * ) Notice: Subject to any disclaimer, the term of this patent is extended or adjusted under 35 U.S.C. 154(b) by 406 days.

(21) Appl. No.: 16/489,230

(22) PCT Filed: Mar. 6, 2018

(86) PCT No.: PCT/EP2018/055481
§ 371 (c)(1),
(2) Date: Aug. 27, 2019

(87) PCT Pub. No.: WO2018/162486
PCT Pub. Date: Sep. 13, 2018

(65) Prior Publication Data

US 2020/0011527 A1 Jan. 9, 2020

(30) Foreign Application Priority Data

Mar. 7, 2017 (DE) ..... 10 2017 104 769.7

(51) Int. Cl.
*F23D 14/72* (2006.01)
*F23N 5/08* (2006.01)

(52) U.S. Cl.
CPC ..... *F23D 14/725* (2013.01); *F23N 5/08* (2013.01); *F23N 2229/00* (2020.01); *F23N 2900/05005* (2013.01)

(58) Field of Classification Search
CPC ..... F23N 5/08; F23N 2229/00; F23N 2900/05005; F23D 14/725
(Continued)

(56) References Cited

U.S. PATENT DOCUMENTS 2,304,641 A * 12/1942 Jones ..... F23N 5/082 431/24
3,055,416 A * 9/1962 Marshall ..... F23N 5/085 431/59
(Continued)

FOREIGN PATENT DOCUMENTS

CN 205079259 U 3/2016
DE 3501719 A1 1/1986
(Continued)

OTHER PUBLICATIONS

PCT International Search Report, PCT/EP2018/055481, dated Jun. 14, 2018, 6 pages.
(Continued)

*Primary Examiner* — Avinash A Savani
(74) *Attorney, Agent, or Firm* — Quarles & Brady LLP

(57) ABSTRACT

Burner (10), in particular for a vehicle heater (12), having an orifice plate (14) separating an inner combustion region (16) from an outer region (18), wherein a photosensitive sensor (20) is arranged in the outer region (18), wherein at least two separate air inlet openings (22, 24, 26, 28) are being provided in the orifice plate (14), wherein one of the at least two air inlet openings (22, 24, 26, 28) is additionally formed as a light opening (28) which also allows light to pass from the inner combustion region (16) to the photosensitive sensor (20) that is arranged in the outer region (18), wherein the at least two air inlet openings (22, 24, 26, 28) are being shaped such that the same combustion air quantities flow into the internal combustion region (16) per unit time, respectively, and wherein the orifice plate (14) is transparent and/or the
(Continued)

Figure 1:
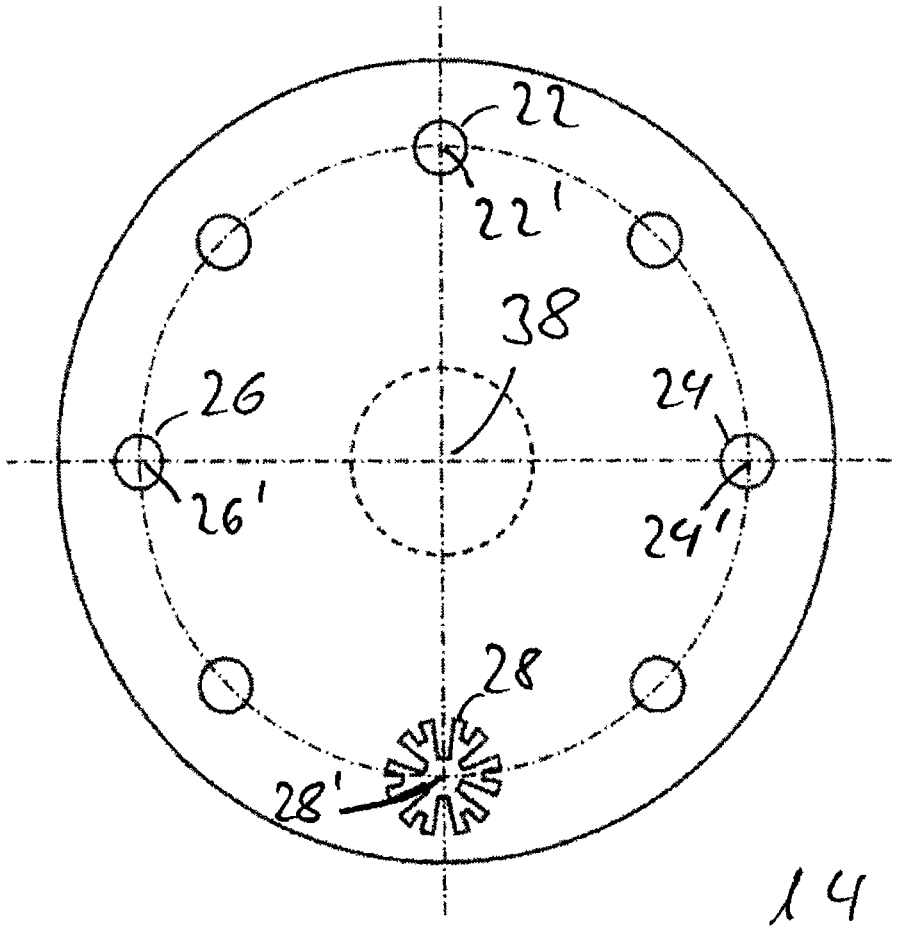

light opening (28) has a shape different from the air inlet openings (22, 24, 26) that are not formed as light opening such that an illumination area defined by the light opening (28) is larger than a reference illumination area defined by one of the at least two air inlet openings (22, 24, 26) that are not formed as light opening (28).

11 Claims, 14 Drawing Sheets

(58) Field of Classification Search
USPC ..... 431/24, 89
See application file for complete search history.

(56) References Cited

U.S. PATENT DOCUMENTS

| | | | | |
|---|---|---|---|---|
| 3,185,846 | A | 5/1965 | Gilbert et al. | |
| 3,276,506 | A * | 10/1966 | Walter | F23N 5/08 431/24 |
| 3,613,062 | A * | 10/1971 | Bloice | F23N 5/082 431/13 |
| 4,793,799 | A * | 12/1988 | Goldstein | F23N 5/082 431/79 |
| 5,120,975 | A | 6/1992 | Fedor et al. | |
| 2007/0119147 | A1 | 5/2007 | Cornwell et al. | |
| 2010/0020310 | A1 * | 1/2010 | Merklein | F23N 5/082 356/51 |
| 2016/0208974 | A1 * | 7/2016 | Suganuma | F16L 55/052 |
| 2016/0343226 | A1 * | 11/2016 | Fischer | G08B 17/107 |

FOREIGN PATENT DOCUMENTS

| | | | |
|---|---|---|---|
| DE | 19903767 | A1 | 8/2000 |
| EP | 1130318 | A1 | 9/2001 |
| EP | 1411573 | A2 | 4/2004 |
| GB | 491714 | A | 9/1938 |
| JP | S58190617 | A | 11/1983 |
| JP | 2009250489 | A | 10/2009 |
| JP | 2014105906 | A | 6/2014 |
| WO | 9606306 | A1 | 2/1996 |
| WO | 02070292 | A1 | 9/2002 |
| WO | 2012168068 | A2 | 12/2012 |

OTHER PUBLICATIONS

PCT Written Opinion, PCT/EP2018/055481, dated Jun. 14, 2018, 6 pages [English Language Translation Only].

* cited by examiner

14

19

BURNER WITH IMPROVED ORIFICE PLATE

This application represents the national stage entry of PCT International Application No. PCT/EP2018/055481 filed on Mar. 6, 2018 and claims priority to German Patent Application DE 10 2017 104 769.7 filed on Mar. 7, 2017. The contents of these applications are hereby incorporated by reference as if set forth in their entirety herein.

The present disclosure relates to a burner, in particular for a vehicle heater, with a orifice plate separating an internal combustion zone from an external zone.

Nowadays motor vehicles are often equipped with vehicle heaters, which serve in particular as additional heaters and/or auxiliary heaters. In most cases it is also possible to retrofit vehicle heaters in motor vehicles. Such heaters are also used in other environments, for example in boats, caravans and other mobile or stationary areas. Especially in motor vehicles, the same fuel is often burned in the vehicle heater that is also used for combustion in the drive engine of the motor vehicle, i.e., in particular diesel fuel or gasoline. This fuel, which is available in the vehicle, must be converted to the gaseous state for the purpose of combustion. For this purpose, mainly the principles of atomisation and/or evaporation are used.

In atomizing burners, for example, an atomizer nozzle can be provided for this purpose, by means of which the fuel is first converted into droplet form, only to then change over to the gaseous state due to the thermal energy present in the vehicle heater. The oxidant required for combustion is continuously supplied to the combustion region in the vehicle heater in the form of a combustion air stream. In many cases, a device for flame detection is also assigned to the burners of the vehicle heaters. This is a sensor of any kind which detects the presence of a flame in the burner and transmits a corresponding signal to a control unit of the vehicle heater.

The control and regulation parameters of the vehicle heater are set depending on this, for example in the sense of a modification of the burner's operation after successful ignition of the burner or in the case of an intentional or unintentional extinction of the flame, whereby in particular the fuel supply is then interrupted.

Figure 13:
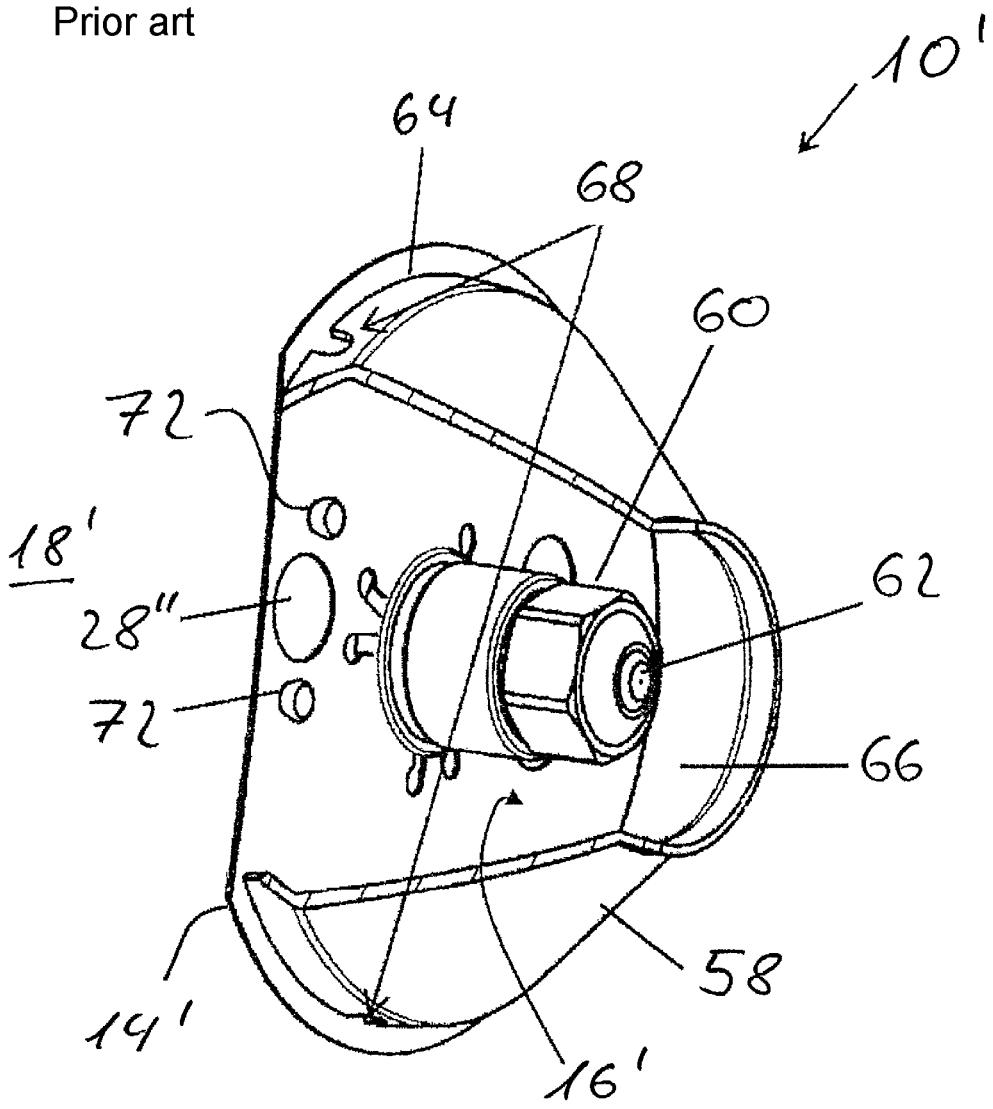
Fig. 13 Prior art
Figure 14:
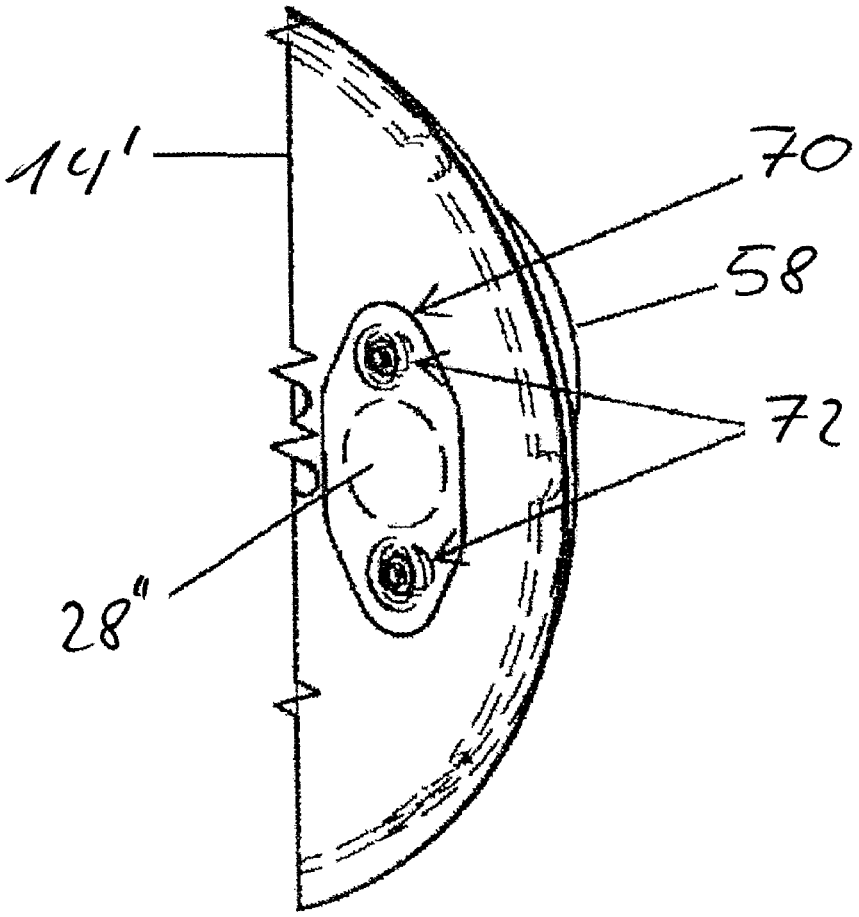
Fig. 14 Prior art

An example of a prior art jet burner is shown in FIG. 13 in partially cut open representation. A detail of this jet burner is shown in FIG. 14. The burner 10' has an inner combustion region 16' which is limited by a funnel-shaped wall 58. The funnel-shaped wall 58 is shown partly cut open in this representation. This provides a view into the inner combustion region 16'. You can see a nozzle 60 which can be supplied with fuel. During operation of the burner 10', the fuel emerges from a nozzle opening 62 and is thus led to evaporation and subsequent combustion. The inner combustion region 16' is further limited by an orifice plate 14', which is shown here cut off, wherein the orifice plate 14' has an essentially circular disc shape. An edge 64 of the funnel-shaped wall 58 seats on the orifice plate 14'. By the interaction of the funnel-shaped wall 58 and the orifice plate 14' the inner combustion region 16' is largely limited. The funnel-shaped wall 58 tapers off from the orifice plate 14' and has an opening 66 on its side facing away from the orifice plate 14' in order to allow the distribution of fuel and combustion air and the formation of a flame in the further combustion chamber. Fuel is supplied to the nozzle 60 via a pipe not shown here, which passes through the orifice plate 14' from the side of orifice plate 14' facing away from the nozzle 60. The combustion air required for combustion is supplied to the inner combustion region 16' via openings 68. These are designed in a U-shape and formed in the edge 64 of the funnel-shaped wall 58. By seating the edge 64 of the funnel-shaped wall 58 on the orifice plate 14', the openings 68 are finally defined. The orifice plate 14' itself has a light opening 28" with a diameter of, for example, 12 mm. This allows light to escape from the inner combustion region 16' to the outer region 18' of the burner 10'. This light reaches a photosensitive sensor, for example a photodiode, which is arranged in the outer region 18' of the burner 10' and which serves for flame detection.

To ensure that the combustion air passes from the outer region 18' to the inner combustion region 16' in a defined manner through the openings 68 provided for this purpose in the funnel-shaped wall 58, the light opening 28" is covered with a mica disc 70, so that no combustion air can reach the inner combustion region 16' through the light opening 28". The mica disc 70 is fastened with two rivets 72 to the side of the orifice plate 14' facing away from the nozzle 60. FIG. 14 enables a view at the orifice plate 14' from the side of orifice plate 14' facing away from the nozzle 60 and the funnel-shaped wall 58, where the mica disc 70 attached to orifice plate 14' with rivets 72 can be seen completely. It completely covers the light opening 28". The nozzle burner 10' constructed in this way works reliably as far as possible. Through the openings 68 in the funnel-shaped wall 58 there is a combustion air supply which is easily adjustable by the arrangement and size of the openings 68, and the mica disc 70 prevents the entry of false air through the large light opening 28" of the orifice plate 14' from the outer region 18' into the inner combustion region 16'. At the same time, a sensor located in the outer region 18' can reliably detect the presence of the flame in the inner combustion region 16'.

During the service life of the burner, residues such as soot or unburned fuel are produced during its operation. These can deposit on the mica disc over time, whereby flame detection by the photosensitive sensor is impaired. In extreme cases, the mica disc can even darken optically to such an extent that reliable flame detection can no longer take place at all. Therefore a regular maintenance of such a burner is necessary to check the light transmission of the mica disc and to clean it if necessary. Furthermore, it should also be noted that the sealing effect of the mica disc at the orifice plate can be partially lost due to temperature effects, so that after all false air can penetrate through the light opening after all.

It is the object of the present disclosure to eliminate disadvantages of the prior art burner. In particular, a maintenance-free burner is provided which ensures reliable flame detection, eliminates the occurrence of false air entering the inner combustion region and offers large tolerances during installation at the same time.

This object is solved with the features of the independent claim.

Advantageous embodiments of the disclosure are indicated in the dependent claims.

The present disclosure describes a burner, in particular for a vehicle heater, having an orifice plate separating an inner combustion region from an outer region, wherein a photosensitive sensor is arranged in the outer region, wherein at least two separate air inlet openings being provided in the orifice plate, wherein one of the at least two air inlet openings is additionally formed as a light opening which also allows light to pass from the inner combustion region to the photosensitive sensor that is arranged in the outer region, wherein the at least two air inlet openings being shaped such that the same combustion air quantities flow into the internal combustion region per unit time, respectively, and wherein the orifice plate is transparent and/or the light opening has a shape different from the air inlet openings that are not formed as light opening such that an illumination area defined by the light opening is larger than a reference illumination area defined by one of the at least two air inlet openings that is not formed as light opening. Since the light opening, just like the other air inlet openings, serves to supply combustion air to the inner combustion region, the occurrence of false air flows due to leaks in the area of the orifice plate can be reliably prevented. Through the orifice plate, the combustion air partial mass flow supplied per time unit can be adjusted via the pressure loss and evened out or directed. In this respect, the orifice plate can also be regarded as a flow straightener. The uniform supply is ensured by the shapes of the air inlet openings and the light opening, i.e., by their respective edges surrounding the opening surfaces. The at least one air inlet opening and the light opening have the same pressure drop in the sense of a throttling effect for the combustion air flowing through them, which can, for example, be expressed approximately by an identical hydraulic diameter, provided that the respective outer shape of the at least one air inlet opening and the light opening does not deviate too far from a circular shape. This ensures that the same quantities of combustion air per time unit flow through the respective openings. In the context of this description, two combustion air quantities are regarded as essentially the same combustion air quantities or the same combustion air quantities, which differ from each other by a maximum of 20 percent, preferably by a maximum of 10 percent, more preferably by a maximum of 5 percent. In this context, the smaller of the two combustion air quantities can be regarded as defining 100 percent. Alternatively, within the scope of this description, two combustion air quantities can be regarded as essentially the same combustion air quantities or the same combustion air quantities, which differ from each other by a maximum of 15 percent, preferably by a maximum of 10 percent, more preferably by a maximum of 5 percent. In this context, the larger of the two combustion air quantities can be regarded as defining 100 percent. The "deviation" refers to the combustion air quantity through the light opening compared to the respective combustion air quantity through an air inlet opening. For example, the pressure drop at the light opening can be determined experimentally and adjusted to the pressure drop at the air inlet openings. Furthermore, the reliability of the flame detection by the photosensitive sensor can be improved against mispositioning of the orifice plate, which can occur especially during mounting. If the orifice plate is transparent, light can also pass beyond the edge of the light opening from the inner combustion region to the photosensitive sensor. If the illumination area defined by the light opening is larger than the reference illumination area defined by at least one of the two air inlet openings, the tolerance to misalignment of the orifice plate is also increased. The reference illumination area can be defined as the area which lies in the plane of the photosensitive sensor and is illuminated from the inner combustion region by a reference opening in the form of one of the at least two air inlet openings, which are not designed as a light opening, if the reference opening would be brought to the position intended for the light opening. If the photosensitive sensor is within the reference illumination area, reliable flame detection is possible because it is illuminated. If, however, the photosensitive sensor is outside the reference illumination area, for example due to incorrect positioning of the orifice plate during burner mounting, reliable flame detection is not possible. The illumination area defined by the light opening itself can be determined in the same way as the reference illumination area. The illumination area may be larger than the reference illumination area due to the different shape of the light opening from the other air inlet openings, or at least have a larger tolerance to misalignments of the orifice plate, in particular rotations. If the orifice plate is transparent, the illumination area is essentially unlimited. A distinction between light opening and air inlet opening is purely formal for a transparent orifice plate due to the unlimited illumination area. It is conceivable, for example, that the "light opening" is located so far away from the photosensitive sensor that it can only be reached by light rays from the inner combustion region that have passed through the transparent material of the transparent orifice plate. This case should also be explicitly regarded as the passage of light through the light opening from the inner combustion region to the photosensitive sensor arranged in the outer region. The light opening and the air inlet openings can, for example, be subsequently punched, cut, milled, drilled, lasered or inserted into the orifice plate in another manufacturing process known to the person skilled in the art. Depending on the material selected for the orifice plate, it is also possible to produce the orifice plate directly with the openings in a casting process, in particular an injection moulding process.

Alternatively, in the case of a transparent orifice plate, it is also possible for the orifice plate to include a light opening which, in the absence of an opening that can be passed by air, does not simultaneously serve as an air inlet opening. In this case, the light opening may be defined as the area of the transparent orifice plate through which the light passes through the transparent material of the orifice plate from the inner combustion region to the photosensitive sensor arranged in the outer region. In the case described above, where the light opening of a transparent orifice plate does not serve as an air inlet opening at the same time, it may also be provided that the orifice plate has at least one air inlet opening.

It may be useful to provide that the orifice plate consists of a metallic material or a heat-resistant plastic or a transparent mineral. A heat-resistant plastic material suitable for the application at hand may, for example, belong to the class of polyether sulfones. Polyether sulfones can show a high transparency paired with stiffness and temperature resistance. A suitable transparent mineral may, for example, be mica.

It may be advantageous that the at least two air inlet openings with respect to their respective centers in the plane of the orifice plane jointly define a geometric pattern with a symmetry rotation axis of order two or more. This arrangement allows a particularly uniform supply of combustion air to the inner combustion region through the orifice plate.

Furthermore, it may be provided that the light opening consists of a plurality of individual openings separated from one another. By providing several individual openings separated from each other, which together form the light opening, the illumination area defined by the light opening can be particularly large in the plane of the photosensitive sensor. Forms for possible individual openings or the light opening as a whole are, for example, rosette forms, star forms, gridded forms, unstructured forms, forms from geometric elements such as circles, rectangles and triangles, and variations of absolutely symmetrical basic forms. In any case, however, the given pressure loss at the light opening must always be guaranteed with sufficient stability of the orifice plate.

It may be useful to provide that the individual openings, which together form the light opening, form a grid pattern. Providing a grid pattern in the area of the reference illumination area defined by the light opening ensures a substantially uniform brightness of the light emitted from the inner region through the light opening. This enables steady signal detection by the photosensitive sensor, irrespective of any incorrect positioning of the orifice plate, which is advantageous for flame detection. The outer edge of the grid pattern can resemble a circular ring segment, for example, so that the orifice plate has a particularly high tolerance with respect to twisting during mounting. Furthermore, the outer edge of the grid pattern can be regarded as the edge of the light opening. For example, the grid pattern can be regular.

Furthermore, it may be provided that the light opening comprises at least sections of slot-like regions. Also by providing sections of slot-like regions, the illumination area defined by the light opening can be enlarged compared to a reference illumination area. In particular, the provision of sections of slot-like regions makes it particularly easy to compensate for incorrect positioning of the orifice plate, particularly with regard to twisting of the orifice plate during mounting.

Furthermore, it may be provided that the orifice plate is at least partially thermally insulated with respect to other components of the burner. By a thermal insulation of the orifice plate against other components of the burner can reduce the temperature load on the orifice plate, so that more temperature-sensitive materials, which are usually cheaper or easier to process, can be used to manufacture the orifice plate. The thermal insulation of the orifice plate can, for example, be provided in the form of seals on the outer edge of the orifice plate against other components of the burner which limit the inner combustion region.

This disclosure is described in the following with reference to the accompanying drawings on the basis of preferred embodiments.

Figure 2:
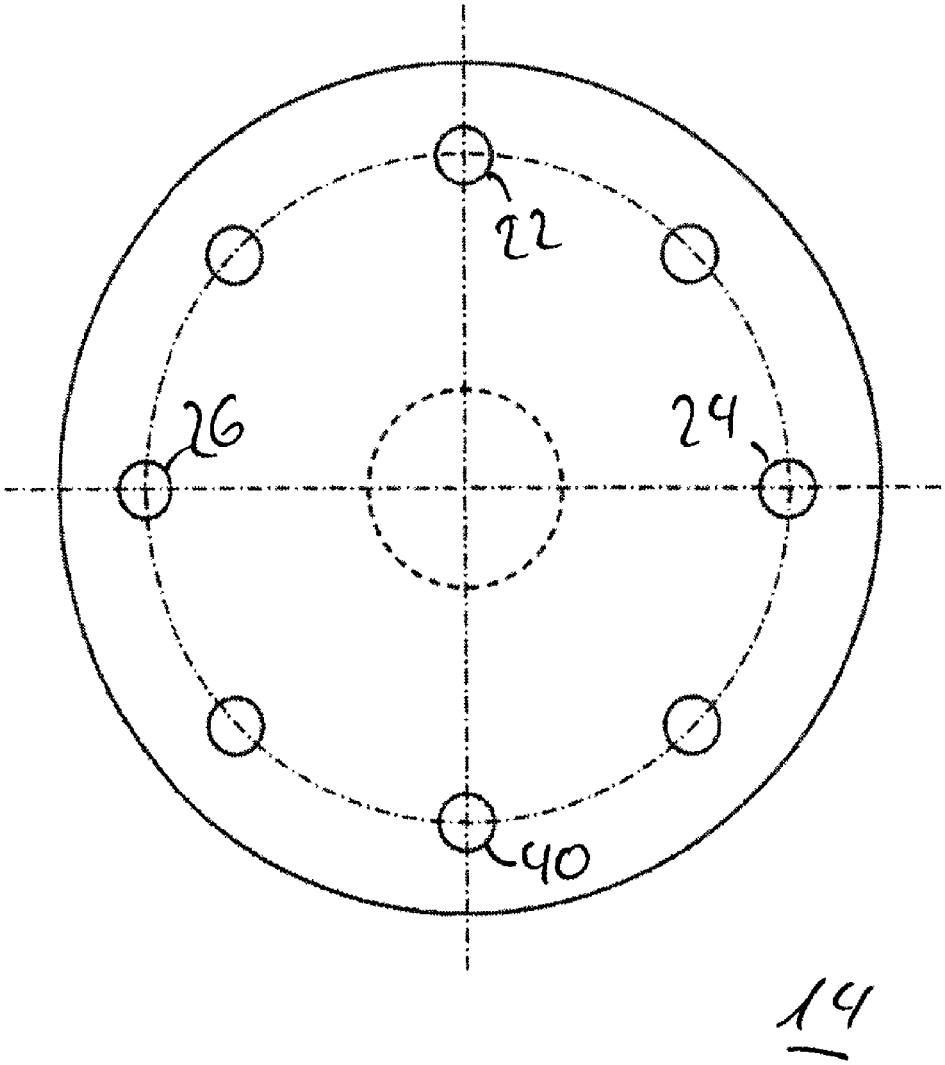
Figure 3:
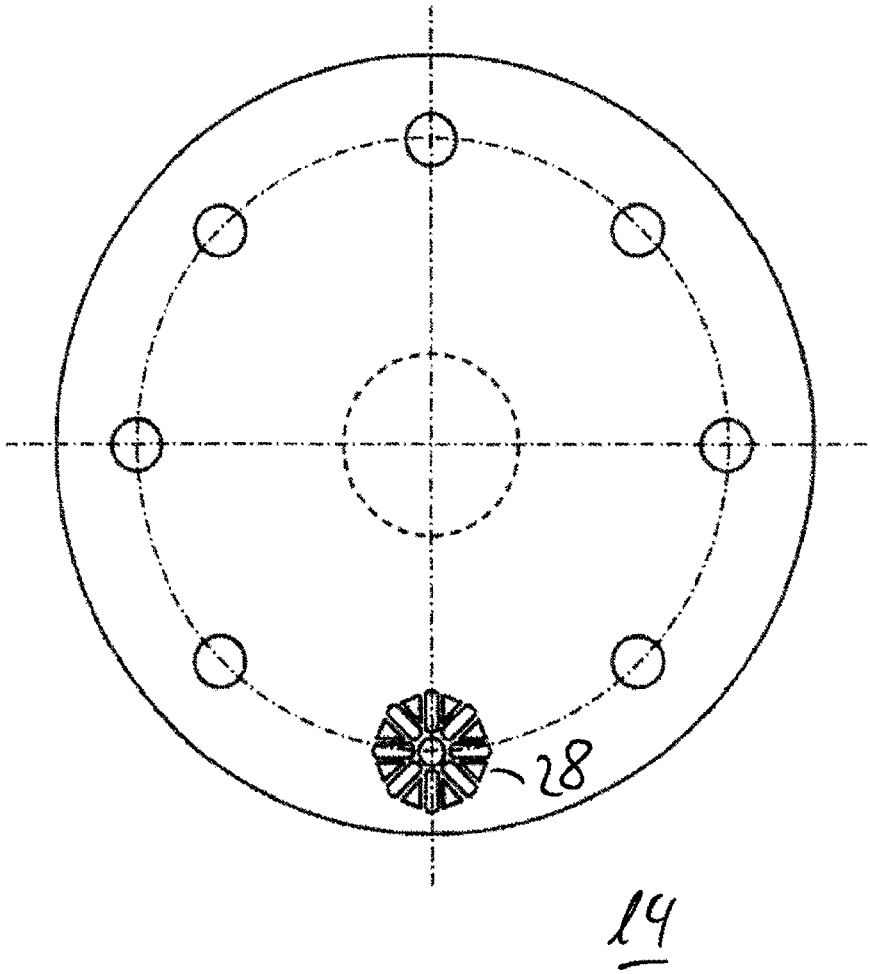
Figure 4:
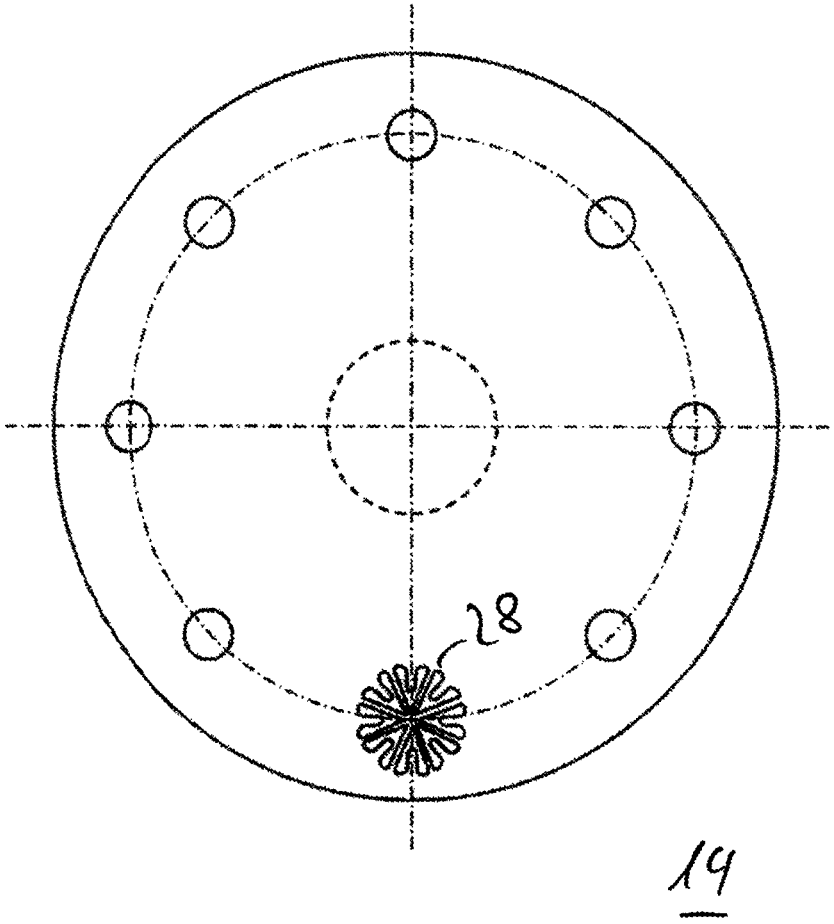
Figure 5:
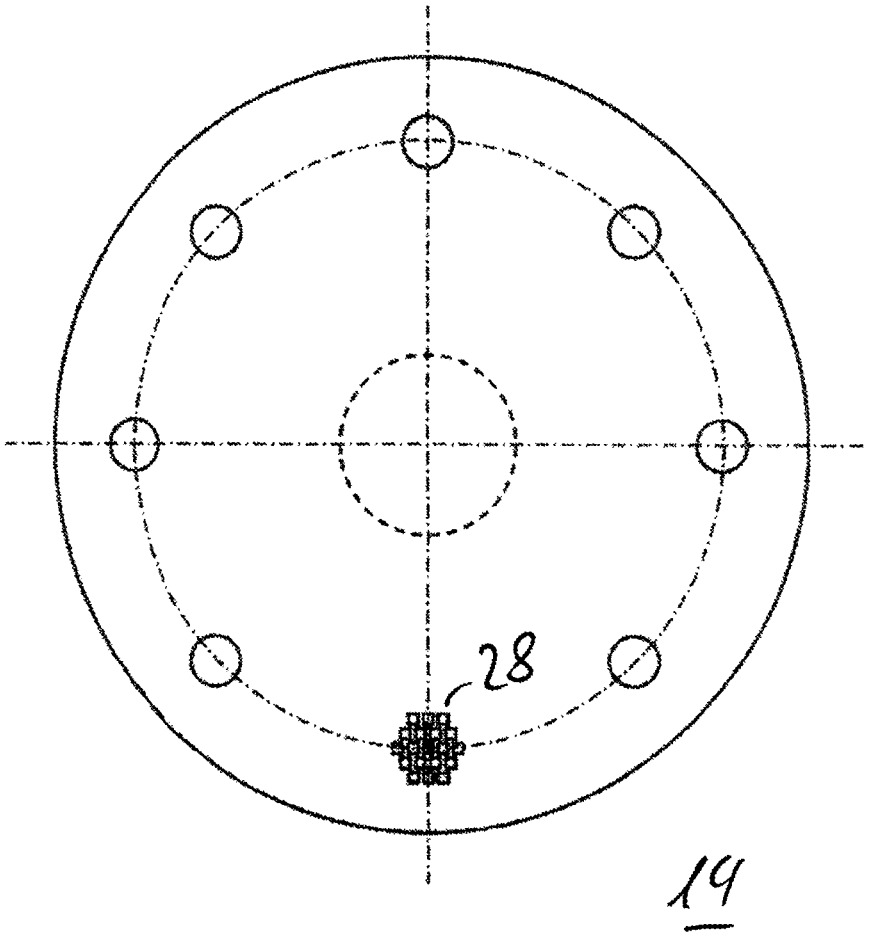
Figure 6:
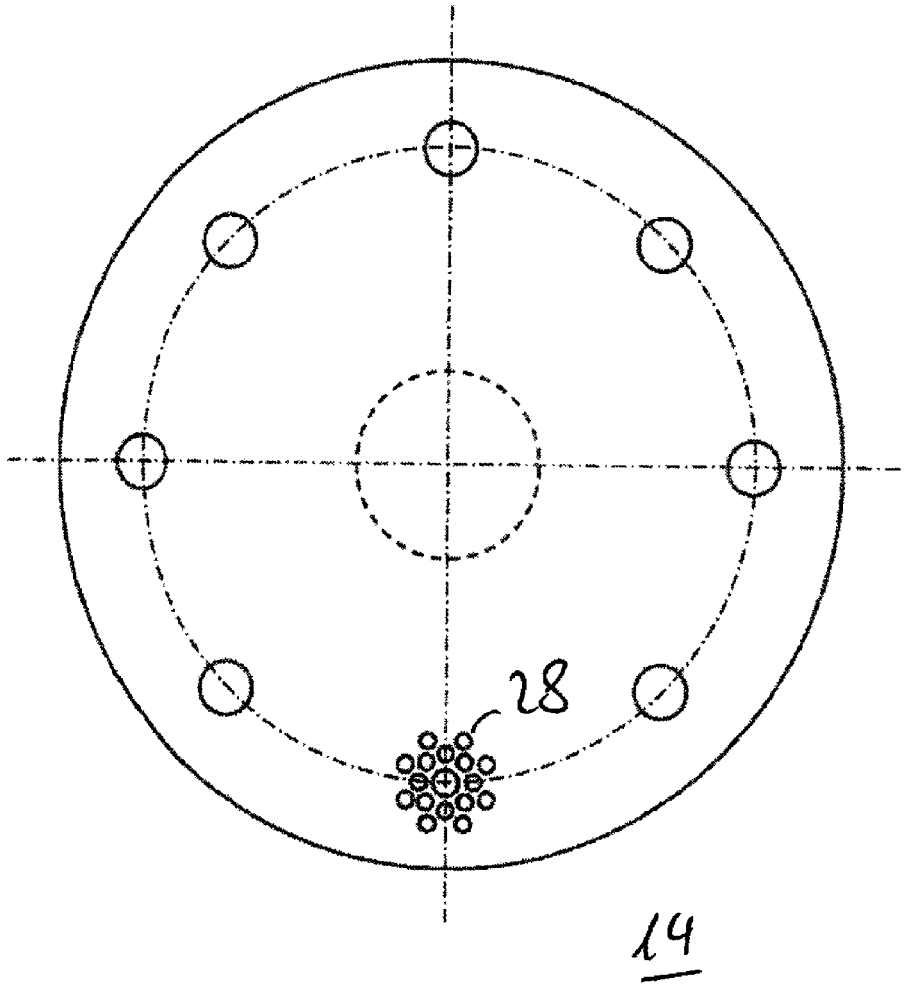
Figure 7:
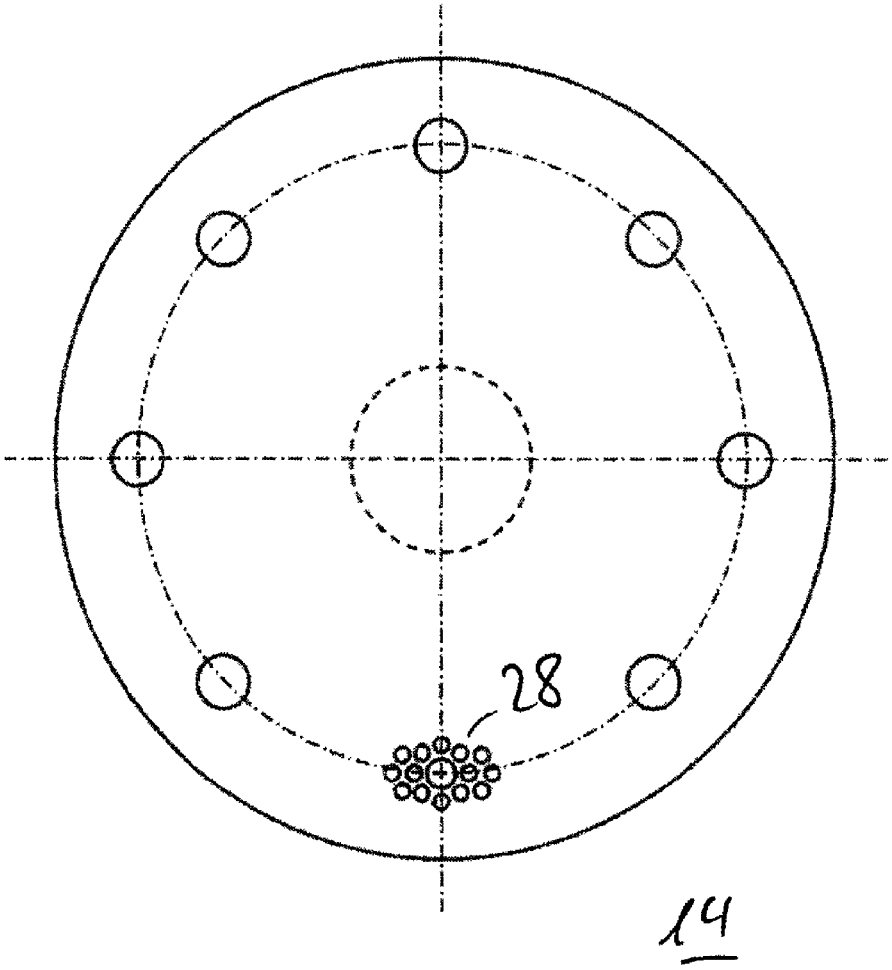
Figure 8:
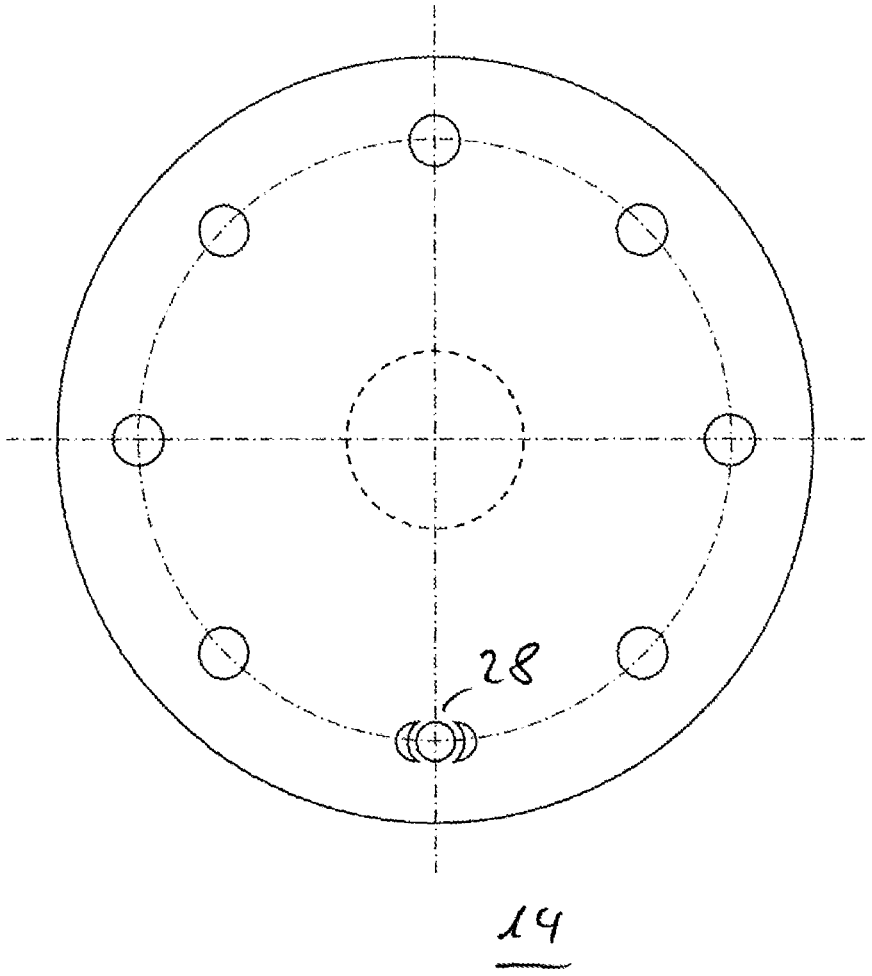
Figure 9:
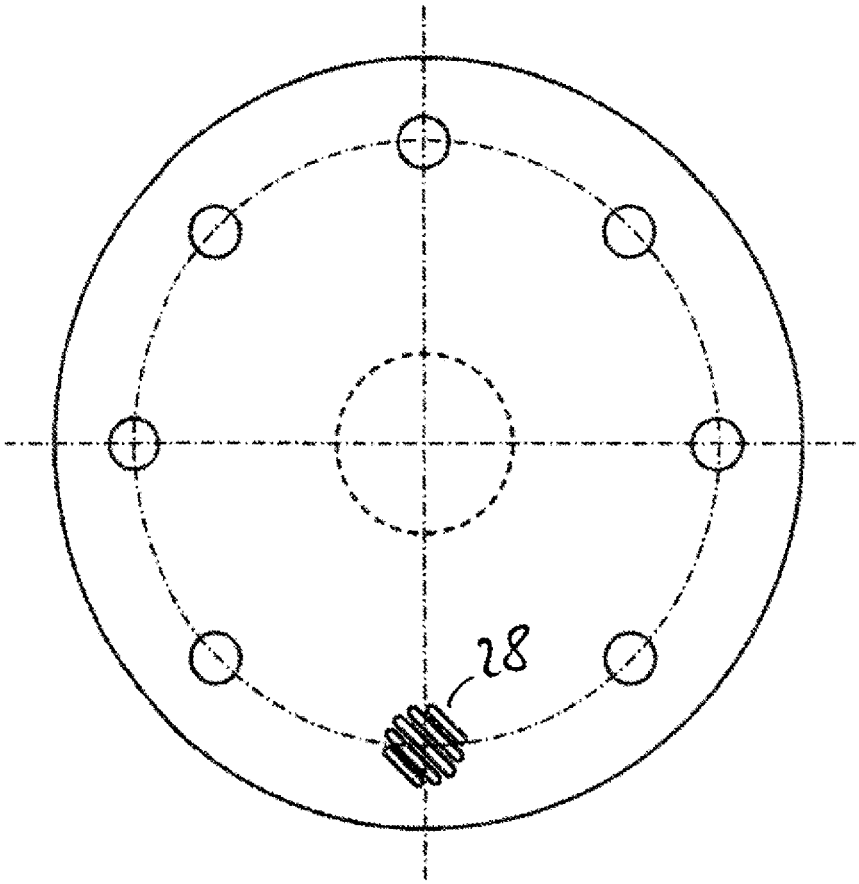
Figure 10:
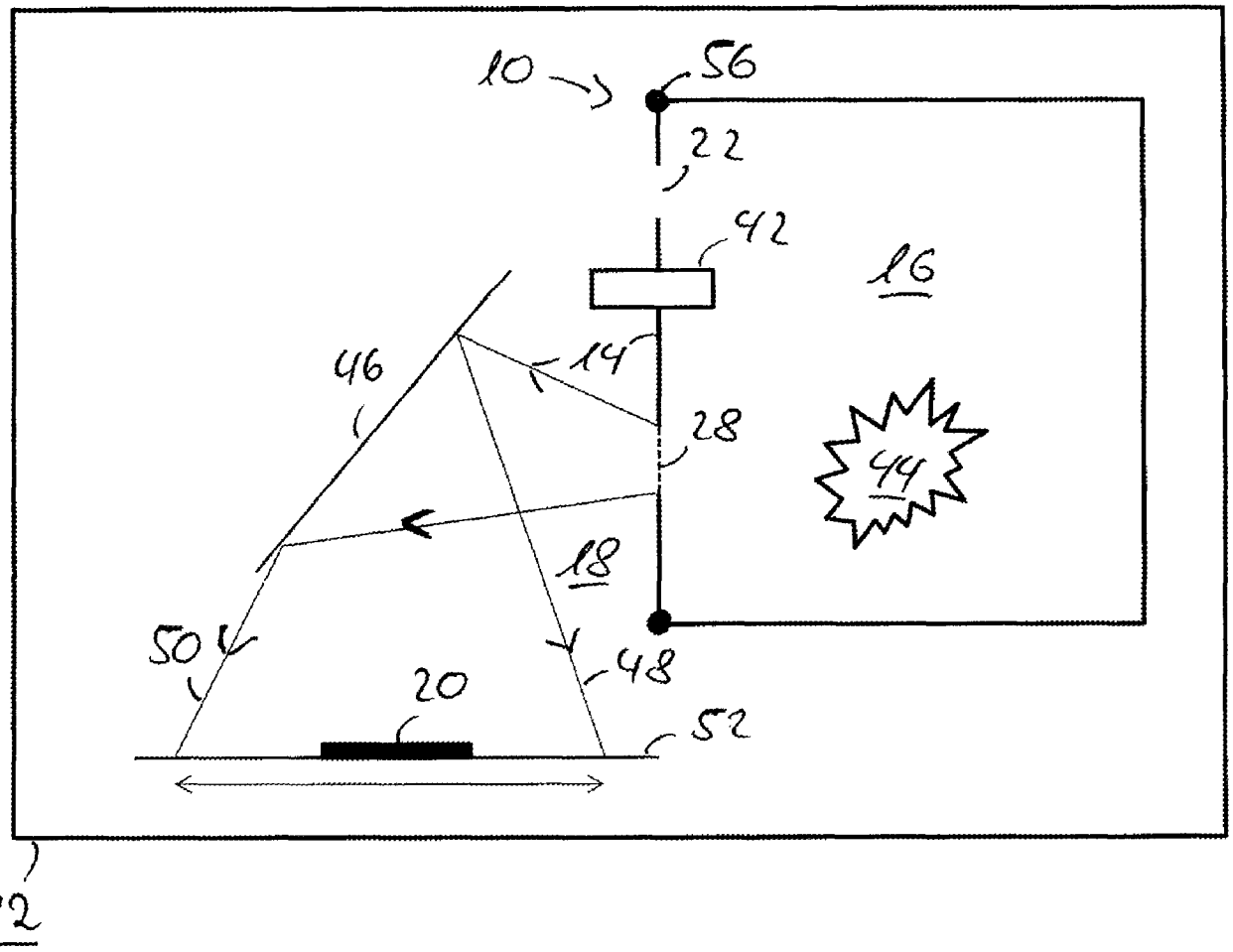
Figure 11:
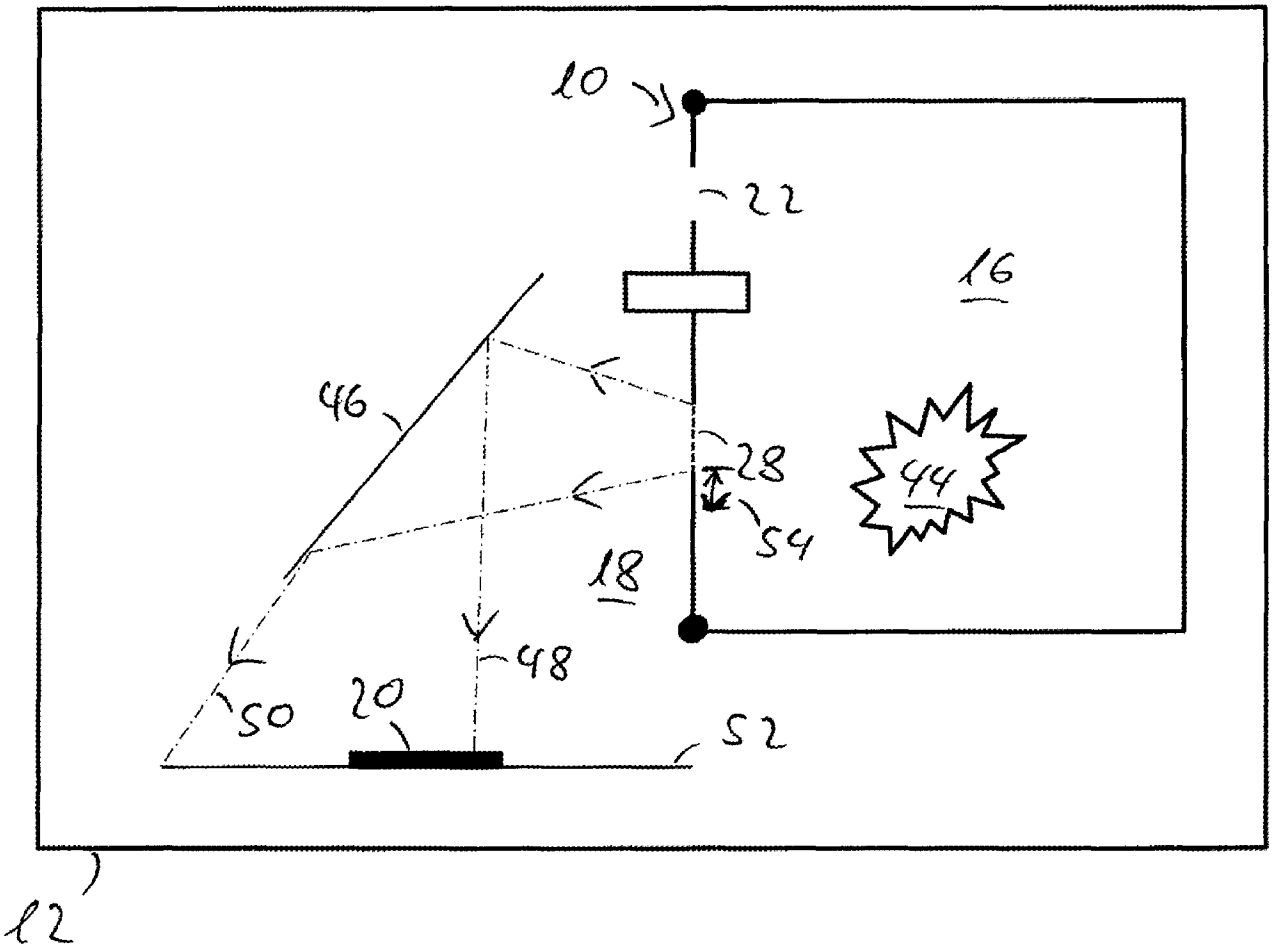
Figure 12:
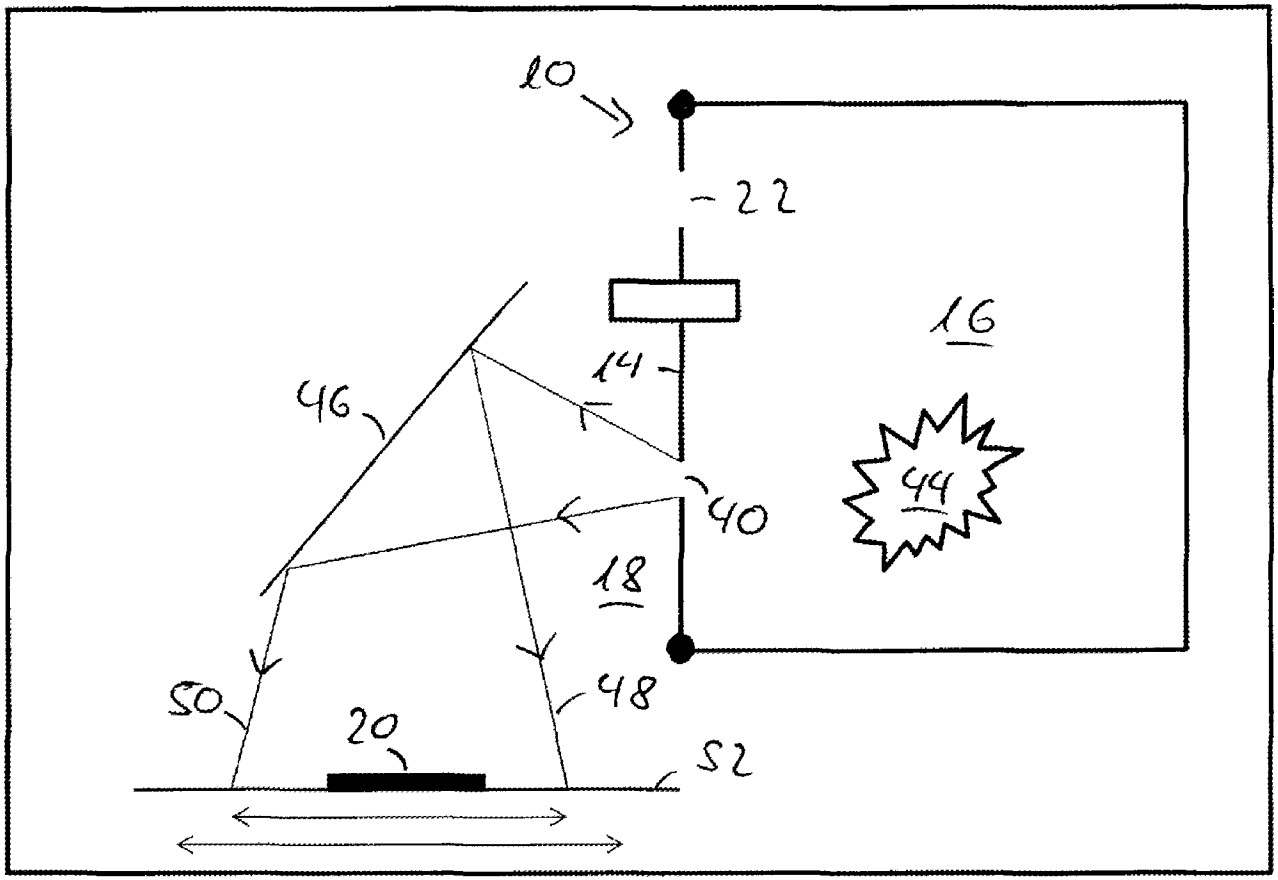

It shows:

FIG. 1 an orifice plate with a first light opening;

FIG. 2 an orifice plate with a reference opening;

FIG. 3 an orifice plate with a second light opening;

FIG. 4 an orifice plate with a third light opening;

FIG. 5 an orifice plate with a fourth light opening;

FIG. 6 an orifice plate with a fifth light opening;

FIG. 7 an orifice plate with a sixth light opening;

FIG. 8 an orifice plate with a seventh light opening;

FIG. 9 an orifice plate with an eighth opening;

FIG. 10 a vehicle heater with a burner in a schematically simplified manner;

FIG. 11 a vehicle heater with a burner in a schematically simplified manner with a shifted opening;

FIG. 12 a vehicle heater with a burner in a schematically simplified manner with a reference opening;

FIG. 13 a prior art burner in a partially cut open representation; and

FIG. 14 a detail of the state of the art burner.

In the following description of the drawings, identical reference numerals denote identical or similar components.

FIG. 1 shows an orifice plate with a first light opening. The shown orifice plate 14 is essentially circular. A number of air inlet openings 22, 24, 26 with their respective centers 22', 24' and 26' are recognizable. Furthermore, air inlet openings not further marked with reference signs are recognizable. In the lower area of the orifice plate 14, an opening specially shaped as a light opening 28 is recognizable in the orifice plate 14. The light opening 28 is not closed and also serves for the passage of combustion air through the orifice plate 14. The light opening 28 has a center 28'. All centers 22', 24', 26', 28' of the air inlet openings 22, 24, 26 and the further air inlet opening designed as light opening 28 are arranged concentrically around a center of the orifice plate 14, which represents a symmetry rotation axis 38 of order two or more. For example, the centers of all air inlet openings and the air inlet opening designed as a light opening can be brought into alignment again and again by successive rotations of the orifice plate 14 by 45° each, so that in the present case there is a symmetry rotation axis 38 of order eight. This high symmetry allows an extremely even passage of combustion air through the orifice plate 14. The outer shape of the light opening 28 shown in FIG. 1 resembles a six-armed 'snowflake'. The passage area released by the light opening 28 shown in FIG. 1 is dimensioned in such a way that the pressure drop at the light opening 28 corresponds to the respective pressure drop at the individual air inlet openings 22, 24, 26, which are not designed as light opening. In this way, during operation of a burner equipped with the orifice plate 14, the same quantity of combustion air per time unit will pass through each of the air inlet openings 22, 24, 26 and the light opening 28 through orifice plate 14.

The ramifications of the light opening 28 recognizable in FIG. 1 enlarge the area "illuminated" by the light opening 28, i.e. the illumination area. Clearly visible is the light opening 28, including the constrictions contouring the light opening 28, significantly larger than the other air inlet openings 22, 24 and 26, which are not designed as light opening. The light opening 28 resembles a star. Nevertheless, the same amount of combustion air per time unit passes through the opening 28 as through the other individual air inlet openings.

FIG. 2 shows an orifice plate with a reference opening. Instead of the light opening 28 shown in FIG. 1, FIG. 2 shows a reference opening 40 at the same position of the orifice plate 14. The reference opening 40 has the same external shape and dimensions as the other air inlet openings 22, 24, 26. A reference illuminating area is thus defined by the reference opening, which corresponds in its shape to one of the other air inlet openings 22, 24, 26, which will be explained in more detail below in connection with FIGS. 10 to 12.

If a suitable transparent material is chosen as the material for the orifice plate 14, the light opening 28 may preferably be designed such that its external shape is identical to the external shapes of the other air inlet openings 22, 24, 26. This has the advantage that the orifice plate 14 is particularly easy to manufacture. Due to the transparency of the orifice plate 14, the resulting illumination area is essentially unlimited, regardless of the shape of the light opening 28, since light can pass through the entire orifice plate 14.

FIG. 3 shows an orifice plate with a second light opening 28. The light opening 28 shown in FIG. 3 consists of a plurality of individual openings, each separated from the adjacent openings by thin webs. The plurality of individual openings and the thin webs separating these individual openings from each other are together considerably larger than the other air inlet openings, which are not designed as light opening 28. The light opening 28 shown in FIG. 3 is made up of a combination of several geometric shapes. Nevertheless, the same amount of combustion air per time unit passes through the orifice plate through the opening 28 as through the other individual air inlet openings.

FIG. 4 shows an orifice plate with a third light opening. The light opening 28 shown in FIG. 4, like the light opening 28 shown in FIG. 3, consists of a plurality of individual openings separated by thin webs which, taken as a whole, remind of the shape of a flower or a rosette of "pieces of cake". The plurality of individual openings and the thin webs separating them from each other are, in terms of their area, much larger than the other air inlet openings, which are not designed as light opening. Nevertheless, the same amount of combustion air per time unit passes through the orifice plate through the light opening 28 as through the other individual air inlet openings.

FIG. 5 shows a further orifice plate with a fourth light opening. The light opening 28 shown in FIG. 5 is formed as a regular grid with square grid openings, which in their entirety, i.e., the grid openings and the individual webs separating the grid openings from each other, have a significantly larger area than the other air inlet openings which are not designed as light opening 28. Nevertheless, the same amount of combustion air per time unit passes through the orifice plate through the light opening 28 as through the other individual air inlet openings. In addition to the grid shown in FIG. 5, any other geometric basic elements for the grid providing the light opening are also conceivable. This also includes grids of unstructured forms, which can consist of a large number of polygonal grid openings differing from each other and individual webs separating the grid lattice openings from each other.

FIG. 6 shows another orifice plate with a fifth light opening. The light opening 28 shown in FIG. 6 is constructed as a regular arrangement of circular individual openings, each arranged on circular lines around a central opening. Here, too, the individual openings, together with the webs separating the individual openings, are considerably larger than the other air inlet openings, which are not designed as light opening. Nevertheless, the same amount of combustion air per time unit passes through the orifice plate through the light opening 28 as through the other individual air inlet openings.

FIG. 7 shows another orifice plate with a sixth light opening. The light opening 28 shown in FIG. 7 comprises a central opening and, separated from it by thin webs, a plurality of surrounding smaller openings. The smaller openings are essentially arranged along a concentric circumferential line on which the centers of the other air inlet openings and the light opening 28 itself lie. The outer shape of the plurality of individual openings and the thin webs separating them from each other is accordingly oval. Due to this oval outer shape, the light opening 28 shown in FIG. 7 is particularly suitable for compensating a twisting of the orifice plate 14 around the symmetry rotation axis 38. Also with the light opening 28 shown in FIG. 7 the same amount of combustion air per time unit passes through the orifice plate through the light opening 28 as through the other individual air inlet openings.

FIG. 8 shows another orifice plate with a seventh light opening. The light opening 28 shown in FIG. 8 consists of a central opening framed at the sides by crescent-shaped secondary openings. In this way, an oval-like overall shape of the light opening 28 is created, divided by two webs, which tolerates twisting of the orifice plate during its mounting particularly well. Also with the light opening 28 shown in FIG. 8 the same amount of combustion air per time unit passes through the orifice plate through the light opening 28 as through the other individual air inlet openings.

FIG. 9 shows another orifice plate with an eighth light opening. The light opening shown in FIG. 9 consists of a plurality of narrow slots arranged parallel to each other, each separated from each other by thin webs. The orientation of the slots can essentially be freely chosen. Also with the light opening 28 shown in FIG. 9 the same amount of combustion air per time unit passes through the orifice plate through the light opening 28 as through the other individual air inlet openings.

FIG. 10 shows a vehicle heater with burner in a schematically simplified manner. The vehicle heater 12 with the burner 10 is recognizable. The burner 10 comprises an inner combustion region 16 and an outer region 18, wherein the inner combustion region 16 is separated from the outer region 18 by an orifice plate 14. Fuel is fed into the inner combustion region 16 via a fuel supply 42, which can be designed as an atomizer nozzle with connected fuel supply, for example. Combustion air is supplied from the outer region 18 into the inner combustion region 16 through the orifice plate 14, wherein the combustion air flows through air inlet openings 22 and a light opening 28. In a simplifying way, only one air inlet opening 22 is shown. An insulating seal 56, which can be arranged in particular at an edge of the orifice plate 14, can thermally insulate the orifice plate 14 from other components of the burner 10, in particular components which limits the inner combustion region 16. In addition to thermal insulation, the insulating seal 56 can also prevent leakage at the edge of the orifice plate so that at the edge of the orifice plate 14 no false air can pass from the outer region 18 to the inner combustion region 16. A flame 44 is usually present in the inner combustion region 16 during operation of the vehicle heater 12. The flame 44 emits light which emerges through the light opening 28 from the inner combustion region 16 to the outer region 18. The outer edge of the light opening 28 limits the bundle of light beams falling out of the inner combustion region 16, whereby edge beams 48, 50 are indicated. FIG. 10 further shows a deflecting device 46, which can be designed as a reflecting surface, for example, and which deflects the bundle of beams exiting the inner combustion region 16 through the light opening 28 in the direction of a photosensitive sensor 20, which is arranged in a plane 52. As long as the photosensitive sensor 20 is in the area between the edge beams 48, 50, a reliable detection of the flame 44 in the inner combustion region 16 is ensured by the photosensitive sensor 20. Due to tolerances in manufacturing of the orifice plate 14 and in mounting of the vehicle heater 12, in particular mounting of the orifice plate 14, the position and size of the light opening 28 in the beam path can vary slightly, so that the area illuminated by the light beams, which is limited by the edge beams 48, 50, can deviate in its position from device to device. In the worst case, the edge beams 48, 50 can illuminate an area which is completely beside the photosensitive sensor 20, or only partially illuminates it, so that a reliable detection of the flame 44 is no longer guaranteed. By enlarging the light opening 28 in relation to the air inlet openings 22, this problem can be avoided within the limits of tolerances without negative effects on the quality of combustion in the inner combustion region. The edge beams 48, 50 define in plane 52, in which the photosensitive sensor 20 is arranged, an illumination area which is indicated below the plane 52 by the double arrow. A possible subdivision of the light opening 28 into a plurality of individual openings by thin webs or similar opaque sections is not relevant for the illumination area, since then a plurality of edge beams generates overlapping individual areas in plane 52, which together form the illumination area. If the orifice plate 14 itself is transparent, the illumination area has practically no edge.

FIG. 11 shows a vehicle heater with a burner in a schematically simplified manner with an offset orifice plate. In the case of the vehicle heater 12 shown in FIG. 11, the light opening 28 is shifted by an offset 54 with respect to the situation shown in FIG. 10. Due to the offset 54, the optical conditions change such that the two edge beams 48, 50 in the figure hit the plane 52 with an offset to the left and the photosensitive sensor 20 is only partially illuminated. The offset 54 of the light opening 28 can be caused, for example, by an inaccurate mounting of the orifice plate 14, for example, by twisted mounting of the orifice plate 14 with respect to a target position.

FIG. 12 shows a vehicle heater with a burner in a schematically simplified manner with a reference opening in the orifice plate. A reference opening 40 is provided in FIG. 12 instead of the light opening 28 present in FIGS. 10 and 11 in the orifice plate 14. In particular, the reference opening 40 may have the same dimensions as the other air inlet openings 22 in the orifice plate 14. In particular, the centers of the reference opening 40 and the light opening 28 provided in FIG. 10 may coincide in order to ensure that the reference illuminating area generated by the reference opening 40 on the plane 52 is comparable. The edge beams 48, 50 given by the reference opening 40 limit the reference illumination area on the plane 52, which is indicated by the smaller double arrow below the plane 52. The larger double arrow underneath corresponds to the double arrow shown in FIG. 10, which belongs to the illumination area defined by the wider light opening 28 opposite to the reference opening 40.

The features of the disclosure as described above, in the drawings as well as in the claims can be essential for the realization either individually or in any combination.

REFERENCE NUMERALS

10 burner
10' burner
12 vehicle heater
14 orifice plate
14' orifice plate
16 inner combustion region
16' inner combustion region
18 outer region
18' outer region
20 photosensitive sensor
22 air inlet opening
22' center
24 air inlet opening
24' center
26 air inlet opening
26' center
28 light opening
28' center
28" light opening
38 symmetry rotation axis
40 reference opening
42 fuel supply
44 flame
46 deflecting device
48 first edge beam
50 second edge beam
52 plane
54 offset
56 insulating seal
58 wall
60 nozzle
62 nozzle opening
64 edge
66 opening
68 opening
70 mica disc
72 rivet

The invention claimed is:

1. Burner for a vehicle heater, having
an orifice plate separating an inner combustion region from an outer region,
wherein a photosensitive sensor is arranged in the outer region,
wherein at least two separate air inlet openings are being provided in the orifice plate,
wherein one of the at least two air inlet openings is additionally formed as a light opening which also allows light to pass from the inner combustion region to the photosensitive sensor that is arranged in the outer region,
wherein the at least two air inlet openings being shaped such that the same combustion air quantities flow into the inner combustion region per unit time, respectively, and
wherein the orifice plate is transparent and/or the light opening has a shape different from the air inlet openings that are not formed as light opening such that an illumination area defined by the light opening is larger than a reference illumination area defined by one of the at least two air inlet openings that are not formed as light opening.

2. Burner according to claim 1, wherein the orifice plate consists of a metallic material or a heat-resistant plastic or a transparent mineral.

3. Burner according to claim 1, wherein the at least two air inlet openings with respect to their respective centers in the plane of the orifice plate jointly define a geometric pattern with a symmetry rotation axis of order two or more.

4. Burner according to claim 1, wherein the light opening consists of a plurality of individual openings separated from one another.

5. Burner according to claim 4, wherein the individual openings, which together form the light opening, form a grid pattern.

6. Burner according to claim 1, wherein the light opening comprises at least sections of slot-like regions.

7. Burner according to claim 1, wherein the orifice plate is at least partially thermally insulated from other components of the burner.

8. Burner according to claim 1, further comprising an internal wall defining the inner combustion region.

9. Burner according to claim 8, wherein the orifice plate is mounted to an outer edge of the internal wall to separate the inner combustion region from the outer region.

10. Burner according to claim 8, further comprising a seal arranged on an edge of the orifice plate.

11. Burner according to claim 10, wherein the seal is arranged between the orifice plate and the wall.

* * * * *